US011380275B2

(12) United States Patent
Lan et al.

(10) Patent No.: US 11,380,275 B2
(45) Date of Patent: Jul. 5, 2022

(54) IMAGE PROCESSING METHOD AND DEVICE, DISPLAY DEVICE AND COMPUTER-READABLE STORAGE MEDIUM

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Chuanyan Lan, Beijing (CN); Guoqiang Wu, Beijing (CN); Yong Yu, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 291 days.

(21) Appl. No.: 16/621,315

(22) PCT Filed: Apr. 25, 2019

(86) PCT No.: PCT/CN2019/084227
§ 371 (c)(1),
(2) Date: Dec. 11, 2019

(87) PCT Pub. No.: WO2019/237837
PCT Pub. Date: Dec. 19, 2019

(65) Prior Publication Data

US 2021/0327370 A1 Oct. 21, 2021

(30) Foreign Application Priority Data

Jun. 11, 2018 (CN) ..... 201810596620.4

(51) Int. Cl.
*G09G 3/36* (2006.01)

(52) U.S. Cl.
CPC ..... *G09G 3/36* (2013.01); *G09G 2310/027* (2013.01); *G09G 2320/0626* (2013.01)

(58) Field of Classification Search
CPC ..... G09G 3/36; G09G 2310/027; G09G 2320/0626; H04N 5/14; G06T 7/90
See application file for complete search history.

(56) References Cited

U.S. PATENT DOCUMENTS

2017/0116902 A1 4/2017 Kuo et al.
2017/0256192 A1* 9/2017 Knepper ..... G09G 3/2092
(Continued)

FOREIGN PATENT DOCUMENTS

CN 104699438 A 6/2015
CN 105575367 A 5/2016
(Continued)

OTHER PUBLICATIONS

First Office Action for Chinese Application No. 201810596620.4, dated Sep. 3, 2019, 6 Pages.
(Continued)

*Primary Examiner* — Andrew Sasinowski
(74) *Attorney, Agent, or Firm* — Brooks Kushman P.C.

(57) ABSTRACT

An image processing method, an image processing method device, a display device and a computer-readable storage medium are provided. The image processing method includes: receiving an original display screen; determining a target area in the original display screen, wherein an initial brightness of the target area is larger than a maximum allowable brightness; determining a target grayscale value of the target area; and adjusting a grayscale value of the target area to the target grayscale value, so that the brightness of the target area does not exceed the maximum allowable brightness.

17 Claims, 7 Drawing Sheets

(56) References Cited

U.S. PATENT DOCUMENTS

| | | | | |
|---|---|---|---|---|
| 2017/0263198 | A1 | 9/2017 | Zhu et al. | |
| 2018/0082660 | A1* | 3/2018 | Xu | G09G 3/3208 |
| 2018/0241979 | A1 | 8/2018 | Kanda et al. | |
| 2018/0357949 | A1 | 12/2018 | Wang et al. | |
| 2019/0026872 | A1* | 1/2019 | Lee | G09G 3/2003 |
| 2019/0266966 | A1 | 8/2019 | Wang | |

FOREIGN PATENT DOCUMENTS

| | | | |
|---|---|---|---|
| CN | 105719611 | A | 6/2016 |
| CN | 106991972 | A | 7/2017 |
| CN | 107045863 | A | 8/2017 |
| CN | 107340986 | A | 11/2017 |
| CN | 108810318 | A | 11/2018 |
| JP | 2008271259 | A | 11/2008 |
| KR | 20170078959 | A | 7/2017 |
| WO | 2017110823 | A1 | 6/2017 |

OTHER PUBLICATIONS

International Search Report and Written Opinion for Application No. PCT/CN2019/084227, dated Jul. 31, 2019, 10 Pages.

* cited by examiner

IMAGE PROCESSING METHOD AND DEVICE, DISPLAY DEVICE AND COMPUTER-READABLE STORAGE MEDIUM

CROSS-REFERENCE TO RELATED APPLICATIONS

This application is the U.S. national phase of PCT Application No. PCT/CN2019/084227 filed on Apr. 25, 2019, which claims priority to Chinese Patent Application No. 201810596620.4 filed on Jun. 11, 2018 which are incorporated herein by reference in their entireties.

TECHNICAL FIELD

The present disclosure relates to a field of a liquid crystal display technology, and in particular to an image processing method and device, a display device and a computer-readable storage medium.

BACKGROUND

Compared to a liquid crystal display panel, an Active Matrix Organic Light Emitting Diode (AMOLED) display panel has characteristics of faster response speed, higher contrast and broader perspective, and lower power consumption.

SUMMARY

An image processing method, including:

receiving, an original display screen;

determining a target area in the original display screen, wherein an initial brightness of the target area is larger than a maximum allowable brightness;

determining a target grayscale value of the target area; and adjusting a grayscale value of the target area to the target grayscale value, so that the brightness of the target area does not exceed the maximum allowable brightness.

In some embodiments, determining the target area in the original display screen, includes:

if an average grayscale value of an area of the original display screen is larger than an average grayscale value of the original display screen, and a difference between the average grayscale value of the area and the average grayscale value of the original display screen is larger than a preset threshold, determining the area as the target area.

In some embodiments, determining the target grayscale value of the target area, includes:

determining, an initial brightness and a target brightness of the target area, wherein the target brightness is no larger than the maximum allowable brightness; and determining the target grayscale value according to a relationship between brightness and grayscale value, the initial brightness and the target brightness.

In some embodiments, determining, the target grayscale value according to the relationship between brightness and grayscale value, the initial brightness and the target brightness, includes:

determining the target grayscale value according to the initial brightness, the target brightness and the relationship between brightness and grayscale value expressed as $$L=A*(G/255)^{2.2}$$

wherein L is the target brightness, G is the target grayscale value, and A is the initial brightness.

An image processing device, including:

a receiving module, configured to receive an original display screen;

a first determining module, configured to determine a target area in the original display screen, wherein an initial brightness of the target area is larger than a maximum allowable brightness;

a second determining module, configured to determine a target grayscale value of the target area; and an adjusting module, configured to adjust a grayscale value of the target area to the target grayscale value, so that the brightness of the target area does not exceed the maximum allowable brightness.

In some embodiments, the first determining module includes:

a first determining unit, configured to determine an area as the target area if an average grayscale value of the area of the original display screen is larger than an average grayscale value of the original display screen, and a difference between the average grayscale value of the area and the average grayscale value of the original display screen is larger than a preset threshold.

In some embodiments, the second determining module includes:

a second determining unit, configured to determine an initial brightness and a target brightness of the target area, wherein the target brightness is no larger than the maximum allowable brightness; and a third determining unit, configured to determine the target grayscale value according to a relationship between brightness and grayscale value, the initial brightness and the target brightness.

In some embodiments, the third determining unit includes:

a determining subunit, configured to determine the target grayscale value according to the initial brightness, the target brightness, the relationship between brightness and grayscale value expressed as $$L=A*(G/255)^{2.2}$$

wherein L is the target brightness, G is the target grayscale value, and A is the initial brightness.

An image processing device, including a memory, a processor, and a computer program being stored in the memory and capable of running on the processor, the processor is configured to execute the computer program to perform any one of the image processing method described above.

In some embodiments, the processor is further configured to execute the computer program to perform the step of determining the target area in the original display screen, wherein if an average grayscale value of an area of the original display screen is larger than an average grayscale value of the original display screen, and a difference between the average grayscale value of the area and the average grayscale value of the original display screen is larger than a preset threshold, the area is determined as the target area.

In some embodiments, the image processing device according to claim 12, wherein the processor is further configured to execute the computer program to determine the target grayscale value of the target area by:

determining an initial brightness and a target brightness of the target area, wherein the target brightness is no larger than the maximum allowable brightness; and determining the target grayscale value according to a relationship between brightness and grayscale value, the initial brightness and the target brightness.

In some embodiments, the image processing device according to claim 14, wherein the processor is further configured to execute the computer program to perform:

determining the target grayscale value according to the initial brightness, the target brightness and the relationship between brightness and grayscale value expressed as $$L=A*(G/255)2.2$$

wherein L is the target brightness, G is the target grayscale value, and A is the initial brightness.

A display device, including the image processing device described above.

A computer-readable storage medium, in which a computer program is stored, the program is capable of being executed by a processor to perform any one of the image processing method described above.

DETAILED DESCRIPTION

In order to make the technical solutions and characteristics of the present disclosure clearer, some embodiments will be described in detail hereinafter with reference to the accompanying drawings.

Terms "first" and "second" in the description and claims of the present disclosure are used for distinguishing similar objects, rather than describing a particular sequence or prioritize. It should be appreciated that, data used in this way may be interchangeable in appropriate circumstances so that the embodiments of the present disclosure described herein may be implemented, for example, in a sequence other than those illustrated or described herein.

An AMOLED panel in the related art uses a compensation circuit to improve MURA (MURA refers to a phenomenon of various traces resulted from nonuniform brightness of display). However, due to a voltage drop in a power supply circuit inside the compensation circuit, the brightness of the AMOLED panel is abnormal when displaying some specific pictures, which not only affects a user's experience, but also affects a life of the AMOLED panel.

Figure 1:
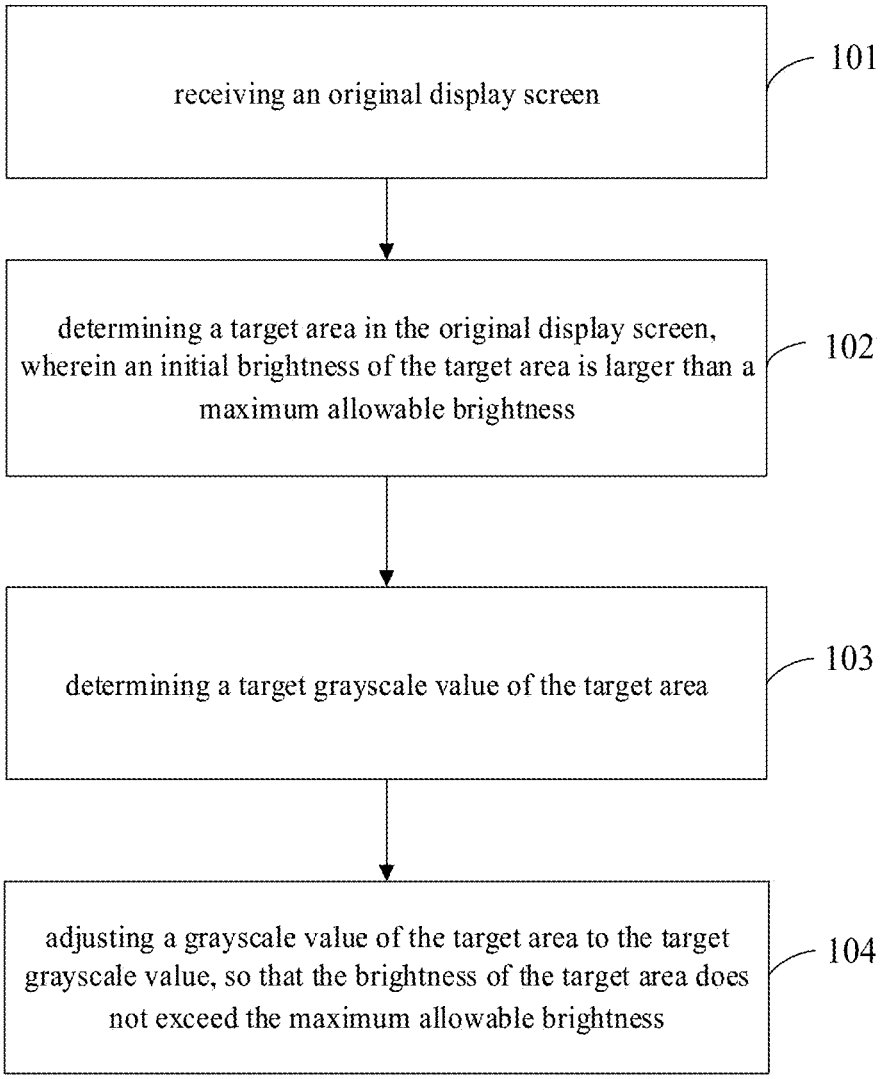
FIG. 1 is a flow chart illustrating an image processing method according to some embodiments of the present disclosure.

FIG. 1 is a flow chart illustrating an image processing method according to some embodiments of the present disclosure, as shown in FIG. 1, the image processing method includes step 101, step 102, step 103 and step 104.

Step 101: receiving an original display screen.

In some embodiments of the present disclosure, the original display screen shows data such as pictures or videos. A type of the original display screen is not limited to the embodiments of the present disclosure.

Step 102: determining, a target area in the original display screen, wherein an initial brightness of the target area is larger than a maximum allowable brightness.

The maximum allowable brightness represents a maximum brightness allowed by a device (such as the AMOLED panel) for displaying the original display screen.

For example, the maximum allowable brightness is set to be 300 nit (corresponding to a grayscale value 255) and is set before leaving the factory.

The target area is an area in which the initial brightness is larger than the maximum allowable brightness in the original display screen.

Figure 2:
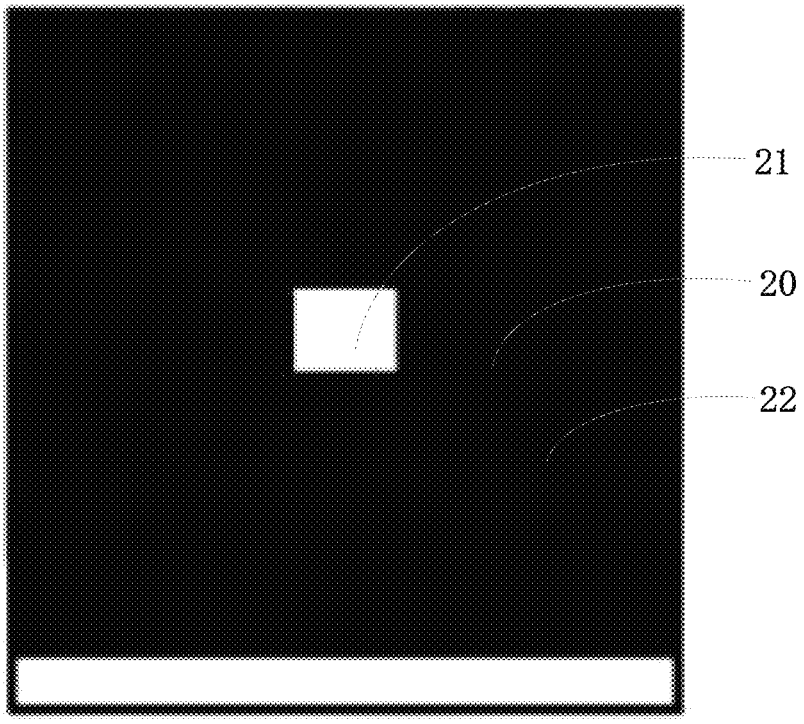
FIG. 2 is a schematic diagram illustrating an original display screen in the related art.

For example, FIG. 2 is a schematic diagram illustrating an original display screen in the related art, as shown in FIG. 2, a background color of an original display screen 20 is black, but there is a highlighted area 21 in a center of the original display screen 20, which accounts for about 1/25 of the original display screen 20. If a maximum allowable brightness is 300 nit (corresponding to a grayscale value 255) and when the background color is white, the corresponding brightness (i.e. the maximum allowable brightness) is 300 nit. However, the brightness of the highlighted area 21 is 400 nit, and the brightness of the highlighted area 21 is larger than the maximum allowable brightness 300 nit. Then the highlighted area 21 is determined as the target area. Table 1 is calculated from the above data.

TABLE 1

| | brightness (Caldera) | brightness increment (Caldera) | area ratio of the highlighted area (%) | average grayscale value |
|---|---|---|---|---|
| full white screen | 300 | 0 | 100% | 255 |
| original display screen 20 | 400 | 400 − 300 = 100 | 1/25 = 4% | 10.2 |

Figure 3:
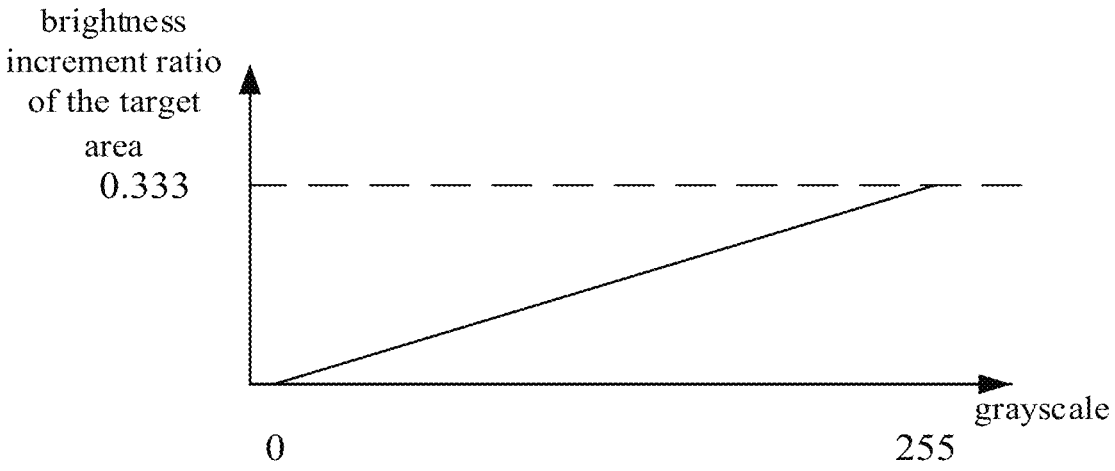
FIG. 3 is a schematic diagram illustrating a relationship between a brightness increment ratio and a grayscale value of a target area in the original display screen shown in FIG. 2.

According to the above data, a relationship between the brightness increment ratio (100/300=0.333) and the grayscale value of the target area may be obtained, referring to FIG. 3.

Figure 4:
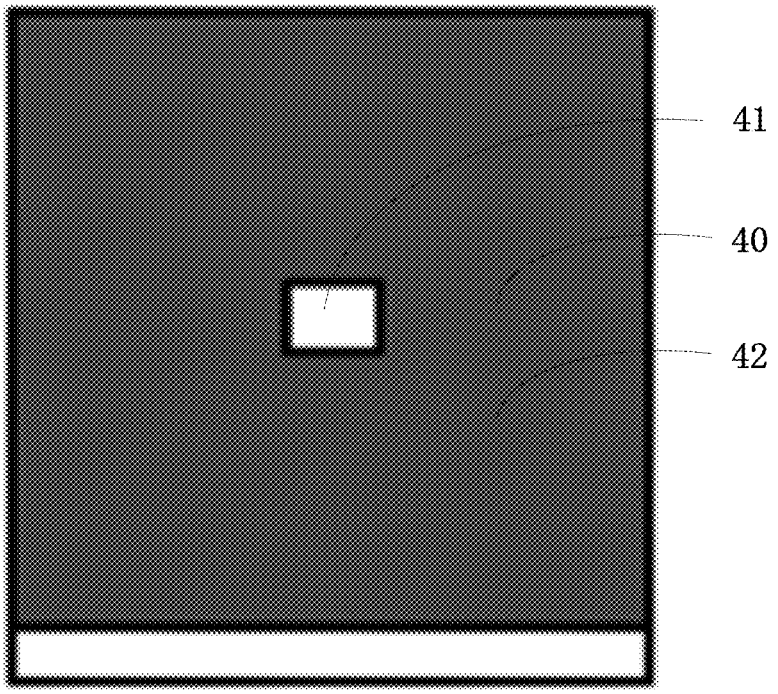
FIG. 4 is a schematic diagram illustrating another original display screen in the related art.
Figure 5:
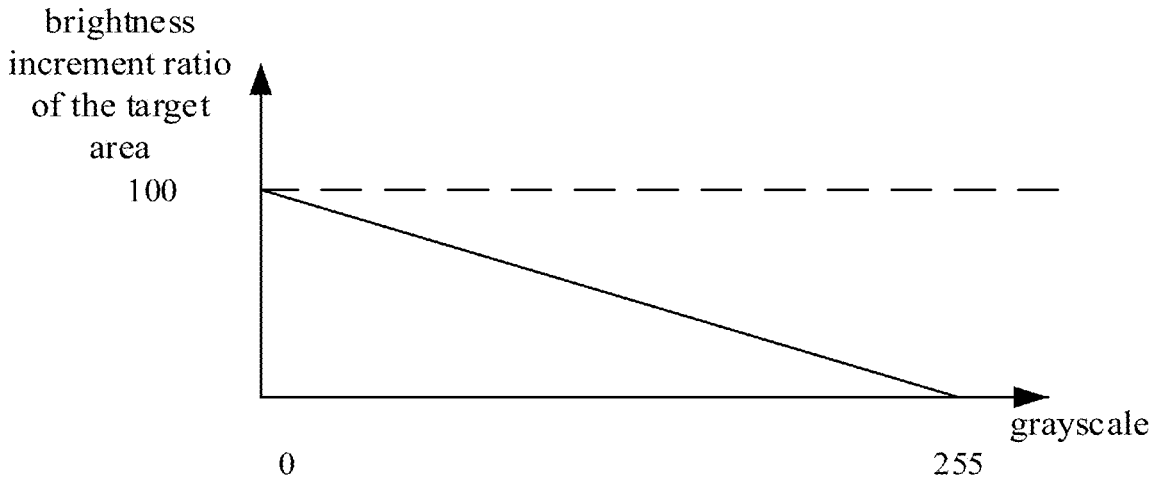
FIG. 5 is a schematic diagram illustrating a relationship between a brightness increment ratios and a grayscale value of a target area in the another original display screen shown in FIG. 4.

As another example, FIG. 4 is a schematic diagram illustrating another original display screen in the related art, as shown in FIG. 4, a background color of an original display screen 40 is gray, but there is a highlighted area 41 in a center of the original display screen 40, which accounts for about 1/25 of the original display screen 40. If a maximum allowable brightness is 300 nit (corresponding to a grayscale value 255) and when the background color is white, the corresponding brightness (i.e. the maximum allowable brightness) is 300 nit. However, the brightness of the highlighted area 41 is 350 nit, and the brightness of the highlighted area 41 is larger than the maximum allowable brightness 300 nit. Then the highlighted area 41 is determined as the target area. According to above data, a relationship between the brightness increment ratio and the grayscale value of the target area may be obtained, referring to FIG. 5.

Step 103: determining, a target grayscale value of the target area.

In the embodiments of the present disclosure, the target grayscale value refers to a grayscale value that may ensure that the brightness of the target area does not exceed the maximum allowable brightness.

In some embodiments, determining the target grayscale value of the target area includes:

determining an initial brightness and a target brightness of the target area, wherein the target brightness is no larger than the maximum allowable brightness; and determining, the target grayscale value according to a relationship between brightness and grayscale value, the initial brightness and the target brightness.

Step 104: adjusting a grayscale value of the target area to the target grayscale value, so that the brightness of the target area does not exceed the maximum allowable brightness.

In the embodiments of the present disclosure, after receiving the original display screen, when there is the area of which the initial brightness is larger than the maximum allowable brightness, the area is determined as the target area to be adjusted. The target grayscale value of the target area is calculated while the brightness of the target area does not exceed the maximum allowable brightness, and the grayscale value of the target area is adjusted to the target grayscale value. Thus the brightness of the target area is adjusted below the maximum allowable brightness, which prolongs the life of the product and improves the user's experience.

When the above image processing method is applied to the AMOLED, the problem that the brightness of some screen is abnormal (not accurate) due to the voltage drop in the internal power supply circuit of the AMOLED panel is solved.

Figure 6:
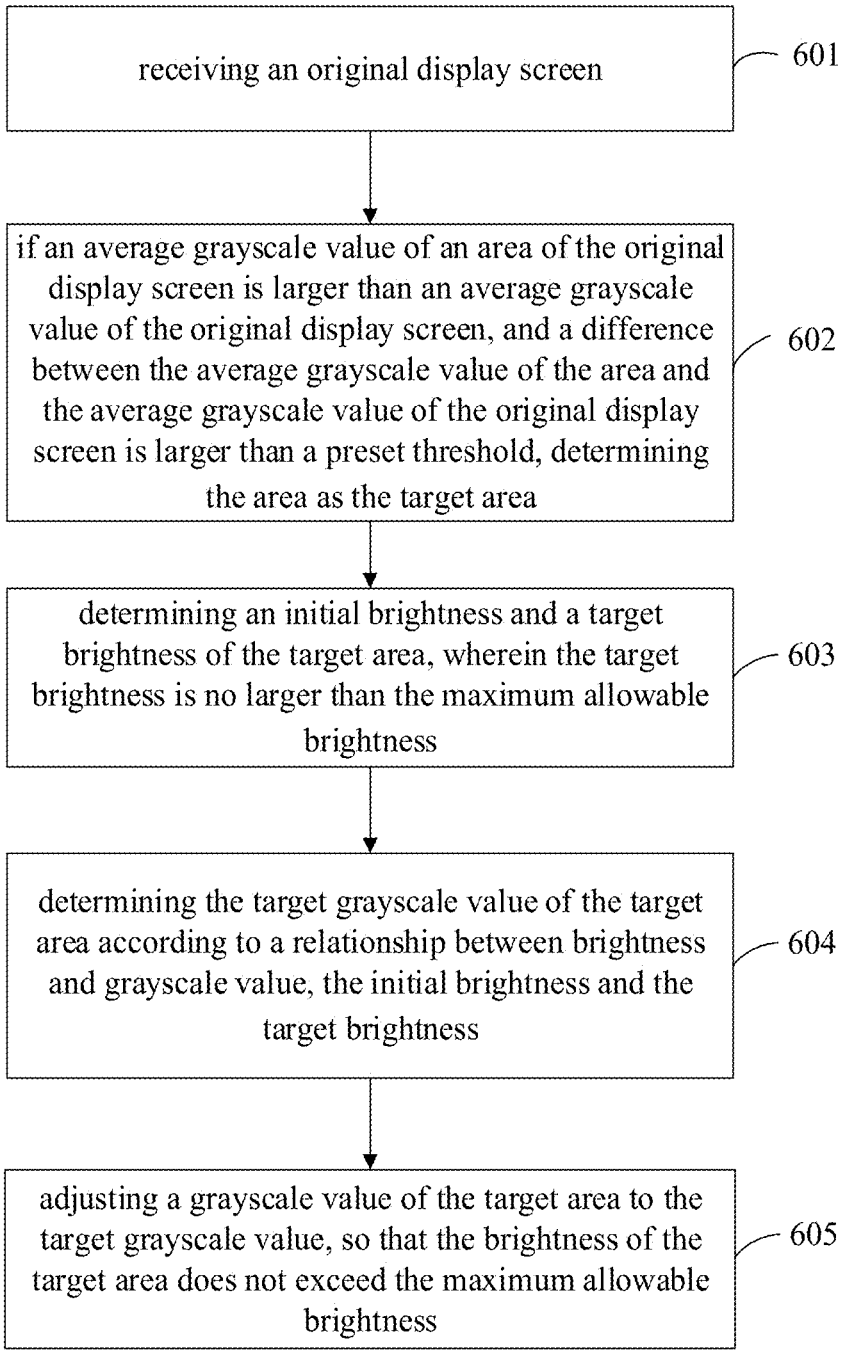
FIG. 6 is a flow chart illustrating an image processing method according to other embodiments of the present disclosure.

FIG. 6 is a flow chart illustrating an image processing method according to other embodiments of the present disclosure, as shown in FIG. 6, the image processing method includes step 601, step 602, step 603, step 604 and step 605.

Step 601: receiving the original display screen.

In some embodiments of the present disclosure, the original display screen is data such as pictures or videos. A type of the original display screen is not limited to the embodiments of the present disclosure.

Step 602: when an average grayscale value of an area of the original display screen is larger than an average grayscale value of the original display screen, and a difference between the average grayscale value of the area and the average grayscale value of the original display screen is larger than a preset threshold, determining the area as the target area.

In the embodiments of the present disclosure, the target area is an area in which the initial brightness is larger than the maximum allowable brightness in the original display screen. The maximum allowable brightness represents a maximum brightness allowed by a device (such as the AMOLED panel) for displaying the original display screen. For example, the maximum allowable brightness is set to be 300 nit (corresponding to a grayscale value 255) and is set before leaving the factory.

Step 603: determining, an initial brightness and a target brightness of the target area, wherein the target brightness is no larger than the maximum allowable brightness.

Step 604: determining, the target grayscale value of the target area according to a relationship between brightness and grayscale value, the initial brightness and the target brightness.

In some embodiments of the present disclosure, the target grayscale value of the target area is determined by substituting the initial brightness and the target brightness of the target area into the following calculation formula (1)

$$L=A*(G/255)^{2.2} \quad (1)$$

L is the target brightness, G is the target grayscale value, and A is the initial brightness.

In the embodiments of the present disclosure, the target grayscale value refers to a grayscale value that may ensure that the brightness of the target area does not exceed the maximum allowable brightness.

Taking the original display screen shown in FIG. 2 as an example, the initial brightness of the target area is 400 nit, the maximum allowable brightness is 300 nit, and the maximum allowable brightness is set as the target brightness, and the above parameter values are substituted into the above formula, $$300=400(G/255)^{2.2} \quad (2)$$

then G=223.73≈224 (rounded). When the picture of FIG. 2 appears, the grayscale value of the target area should be adjusted from 255 to 224, and the brightness of the target area should be adjusted to 300 nit.

Taking the original display screen shown in FIG. 4 as an example, the maximum allowable brightness is 65.8 nit, the initial brightness of the target area is determined to be 65.8*{0.33*(128/255)}=87.58 nit, and the maximum allowable brightness is set as the target brightness, and the above parameter values are substituted into the above formula, $$65.8=87.58(G/255)^{2.2} \quad (3)$$

then G=112.39≈112 (rounded). When the picture of FIG. 4 appears, the grayscale value of the target area should be adjusted from 128 to 112, and the brightness of the target area should be adjusted to 65.8 nit.

Step 605: adjusting a grayscale value of the target area to the target grayscale value, so that the brightness of the target area does not exceed the maximum allowable brightness.

In some embodiments, on the basis of the above embodiments, the image processing method further includes:

determining an average grayscale value of the original display screen and an average gray scale of the target area.

In some embodiments of the present disclosure, a diagram of curve illustrating a relationship between the grayscale value and brightness of the original display screen is counted and plotted, then the average grayscale value of the original display screen and the average gray scale of the target area are determined according to the diagram of curve.

For example, the brightness and the grayscale value are determined according to an overall grayscale value of an image and a DBV setting value.

In some embodiments, the original display screen is taken from a video, and an average grayscale value of each frame in the video are calculated. An average of the average grayscale values of all frames in the video is taken as the average grayscale value of the original display screen.

Figure 7A:
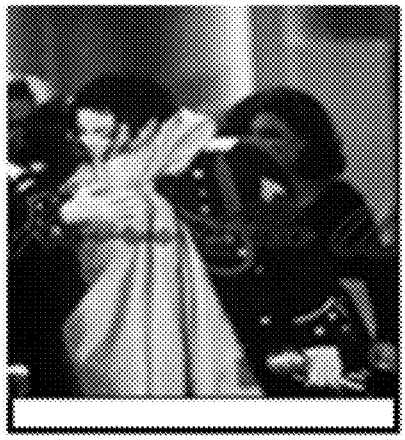
FIG. 7*a* is a schematic diagram illustrating an original display screen according to some embodiments of the present disclosure.
Figure 7B:
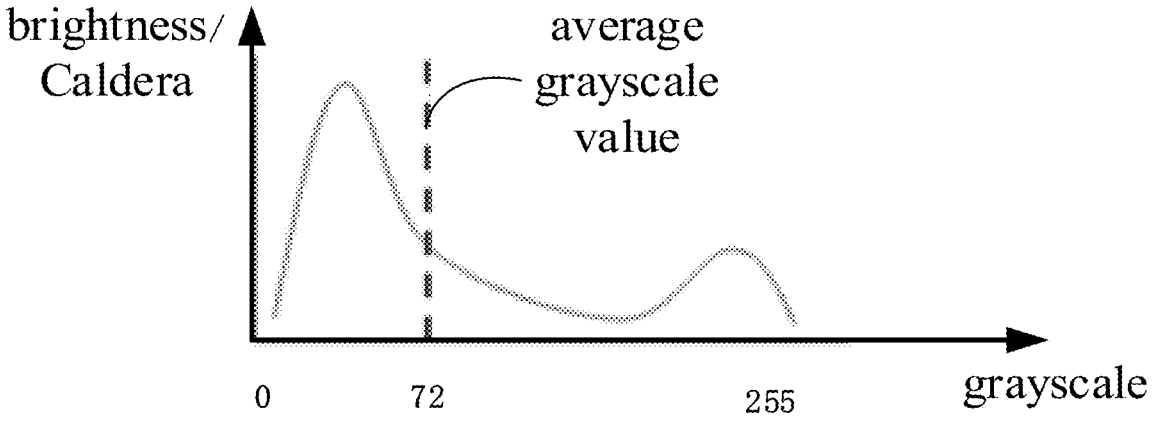
FIG. 7*b* is a schematic diagram illustrating a relationship between a grayscale value and brightness of the original display screen shown in FIG. 7*a;*
Figure 8A:
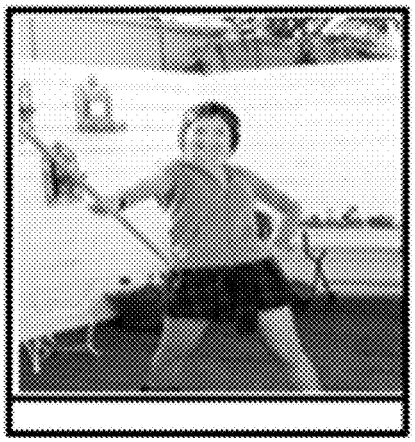
FIG. 8*a* is a schematic diagram illustrating an original display screen according to other embodiments of the present disclosure.
Figure 8B:
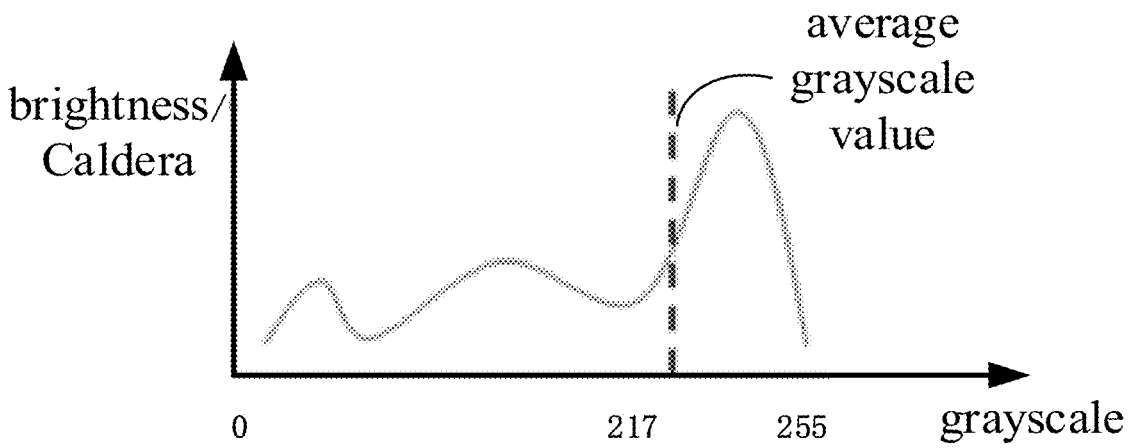
FIG. 8*b* is a schematic diagram illustrating a relationship between a grayscale value and brightness of the original display screen shown in FIG. 8*a;*

For example, FIG. 7*b* is a diagram of curve illustrating a relationship between a grayscale value and brightness of the original display screen shown in FIG. 7*a*, an average grayscale value of the original display screen shown in FIG. 7*a* is 72. FIG. 8*b* is a diagram of curve illustrating a relationship between a grayscale value and brightness of the original display screen shown in FIG. 8*a*, an average grayscale value of the original display screen shown in FIG. 8*a* is 217.

In the embodiments of the present disclosure, after receiving the original display screen, when there is an area of which the initial brightness is larger than the maximum allowable brightness, the area is determined as the target area to be adjusted. The target grayscale value of the target area is calculated while the brightness of the target area does not exceed the maximum allowable brightness, and the grayscale value of the target area is adjusted to the target grayscale value. Then the brightness of the target area is adjusted below the maximum allowable brightness, which prolongs the life of the product and improves the user's experience.

Figure 9:
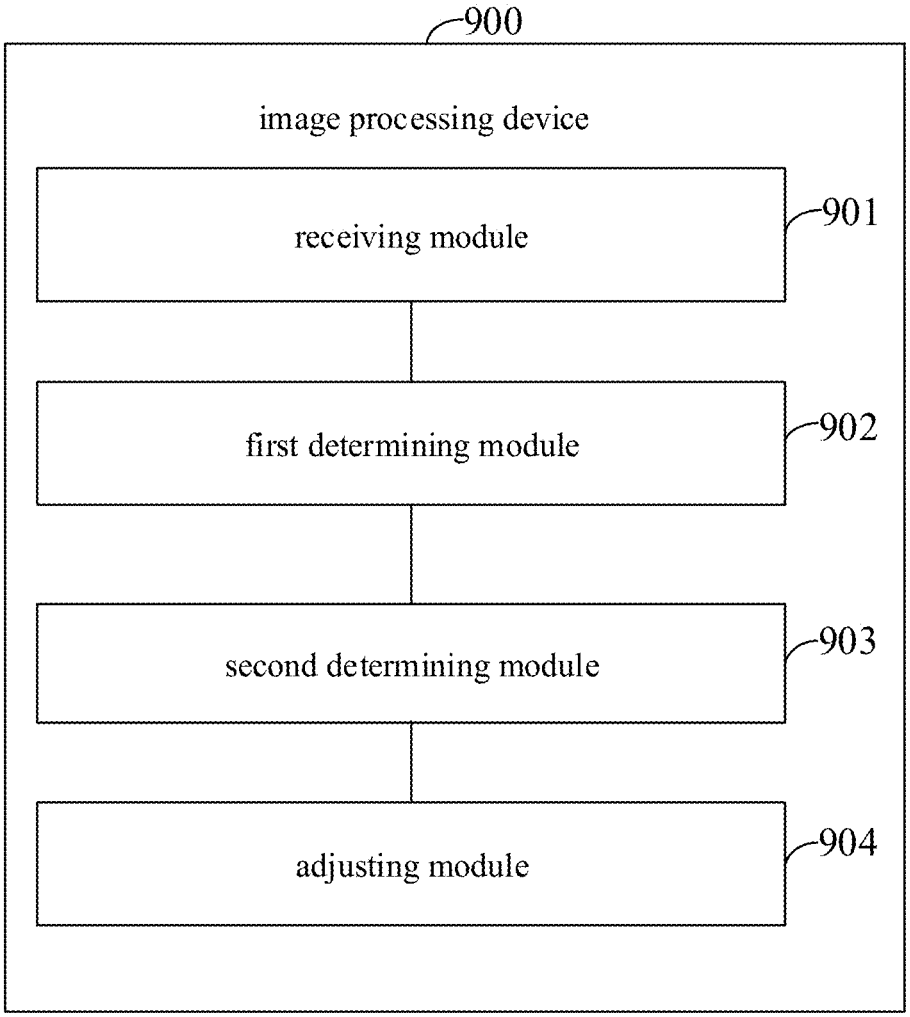
FIG. 9 is a schematic diagram illustrating a structure of an image processing device according to some embodiments of the present disclosure.

FIG. 9 is a schematic diagram illustrating a structure of an image processing device according to some embodiments of the present disclosure, as shown in FIG. 9, an image processing device 900 includes a receiving module 901, a first determining module 902, a second determining module 903, and an adjusting module 904.

The receiving module 901 is configured to receive an original display screen.

The first determining module 902 is configured to determine a target area in the original display screen, wherein an initial brightness of the target area is larger than a maximum allowable brightness.

The second determining module 903 is configured to determine a target grayscale value of the target area.

The adjusting module 904 is configured to adjust a grayscale value of the target area to the target grayscale value, so that the brightness of the target area does not exceed the maximum allowable brightness.

In some embodiments, the first determining module 902 includes a first determining unit.

The first determining unit is configured to determine an area as the target area when an average grayscale value of the area of the original display screen is larger than an average grayscale value of the original display screen, and a difference between the average grayscale value of the area and the average grayscale value of the original display screen is larger than a preset threshold.

In some embodiments, the second determining module 903 includes a second determining unit and a third determining unit.

The second determining unit is configured to determine an initial brightness and a target brightness of the target area, wherein the target brightness is no larger than the maximum allowable brightness.

The third determining unit is configured to determine the target grayscale value according to a relationship between brightness and grayscale value, the initial brightness and the target brightness.

In some embodiments, the third determining unit includes a determining subunit.

The determining subunit is configured to determine the target grayscale value according to the initial brightness of the target area, the target brightness of the target area and a calculation formula $$L=A*(G/255)^{2.2}$$

wherein L is the target brightness of the target area, G is the target grayscale value of the target area, and A is the initial brightness of the target area.

In the embodiments of the present disclosure, the image processing device described above may implement various processes of the method embodiments of FIG. 1 and FIG. 6, which will not be repeated herein for the sake of simplicity.

In the embodiments of the present disclosure, after the receiving module 901 receiving the original display screen, when there is an area of the original display screen where the initial brightness is larger than the maximum allowable brightness, the first determining module 902 determines the area as the target area to be adjusted. The target grayscale value of the target area is then calculated by the second determining module 903 satisfying that the brightness of the target area does not exceed the maximum allowable brightness, and the grayscale value of the target area is adjusted to the target grayscale value by the adjusting module 904. In this way the brightness of the target area is adjusted below the maximum allowable brightness, which prolongs the life of the product and improves the user's experience.

Figure 10:
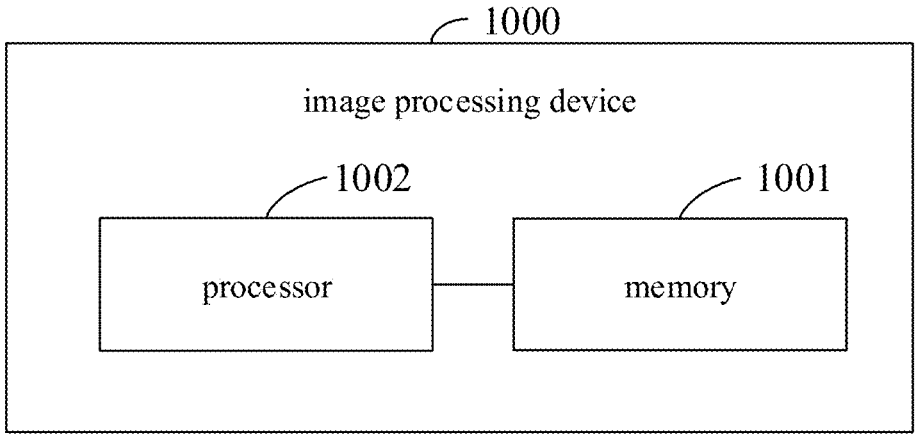
FIG. 10 is a schematic diagram illustrating a structure of an image processing device according to other embodiments of the present disclosure.

Some embodiments of the present disclosure provide an image processing device, as shown in FIG. 10, an image processing device 1000 includes a memory 1001, a processor 1002, and a computer program being stored in the memory 1001 and capable of running on the processor 1002, the processor is configured to execute the computer program, to perform any one of the image processing methods described above.

Some embodiments of the present disclosure provide a display device including the image processing device described above.

In some embodiments, the display device is a device for displaying data such as images or videos, such as a mobile phone, a computer or a tablet computer.

Some embodiments of the present disclosure provide a computer storage medium, in which a computer program is stored, a processor is configured to execute the computer program, to perform the image processing method described above.

In some embodiments, the computer storage medium is a computer-readable storage medium, such as a Read-Only Memory (ROM), a Random Access Memory (RAM), a magnetic disk or an optical disk, etc.

The above are some embodiments of the present disclosure, it should be appreciated that a person skilled in the art may make various modifications and improvements without departing from the spirit of the present disclosure.

What is claimed is:

1. An image processing method, comprising:

receiving an original display screen;

determining a target area in the original display screen, wherein an initial brightness of the target area is larger than a maximum allowable brightness;

determining a target grayscale value of the target area; and adjusting a grayscale value of the target area to the target grayscale value, so that the brightness of the target area does not exceed the maximum allowable brightness, wherein determining the target area in the original display screen comprises:

if an average grayscale value of an area of the original display screen is larger than an average grayscale value of the original display screen, and a difference between the average grayscale value of the area and the average grayscale value of the original display screen is larger than a preset threshold, determining the area as the target area.

2. The image processing method according to claim 1, wherein determining the target grayscale value of the target area comprises:

determining an initial brightness and a target brightness of the target area, wherein the target brightness is no larger than the maximum allowable brightness; and determining the target grayscale value according to a relationship between brightness and grayscale value, the initial brightness and the target brightness.

3. The image processing method according to claim 2, wherein determining the target grayscale value of the target area according to the relationship between brightness and grayscale value, the initial brightness and the target brightness, comprises:

determining the target grayscale value according to the initial brightness, the target brightness and the relationship between brightness and grayscale value expressed as $$L=A*(G/255)^{2.2}$$

wherein L is the target brightness, G is the target grayscale value, and A is the initial brightness.

4. An image processing device, comprising a memory, a processor, and a computer program being stored in the memory and capable of running on the processor, the processor is configured to execute the computer program to perform the steps in the image processing method according to claim 1.

5. The image processing device according to claim 4, wherein the processor is further configured to execute the computer program to determine the target grayscale value of the target area by:

determining an initial brightness and a target brightness of the target area, wherein the target brightness is no larger than the maximum allowable brightness; and determining the target grayscale value according to a relationship between brightness and grayscale value, the initial brightness and the target brightness.

6. The image processing device according to claim 5, wherein the processor is further configured to execute the computer program to perform:

determining the target grayscale value according to the initial brightness, the target brightness and the relationship between brightness and grayscale value expressed as $$L=A*(G/255)^{2.2}$$

wherein L is the target brightness, G is the target grayscale value, and A is the initial brightness.

7. A non-transitory computer-readable storage medium, in which a computer program is stored, the computer program is capable of being executed by a processor to perform the steps in the image processing method according to claim 1.

8. The image processing method according to claim 1, wherein determining the target grayscale value of the target area comprises:

determining an initial brightness and a target brightness of the target area, wherein the target brightness is no larger than the maximum allowable brightness; and determining the target grayscale value according to a relationship between brightness and grayscale value, the initial brightness and the target brightness.

9. The image processing method according to claim 8, wherein determining the target grayscale value of the target area according to the relationship between brightness and grayscale value, the initial brightness and the target brightness, comprises:

determining the target grayscale value according to the initial brightness, the target brightness and the relationship between brightness and grayscale value expressed as $$L=A*(G/255)^{2.2}$$

wherein L is the target brightness, G is the target grayscale value, and A is the initial brightness.

10. An image processing device, comprising:

a receiving module configured to receive an original display screen;

a first determining module configured to determine a target area in the original display screen, wherein an initial brightness of the target area is larger than a maximum allowable brightness;

a second determining module configured to determine a target grayscale value of the target area; and an adjusting module configured to adjust a grayscale value of the target area to the target grayscale value, so that the brightness of the target area does not exceed the maximum allowable brightness, wherein the first determining module comprises:

a first determining unit configured to determine an area as the target area if an average grayscale value of the area of the original display screen is larger than an average grayscale value of the original display screen, and a difference between the average grayscale value of the area and the average grayscale value of the original display screen is larger than a preset threshold.

11. The image processing device according to claim 10, wherein the second determining module comprises:

a second determining unit configured to determine an initial brightness and a target brightness of the target area, wherein the target brightness is no larger than the maximum allowable brightness; and a third determining unit configured to determine the target grayscale value according to a relationship between brightness and grayscale value, the initial brightness and the target brightness.

12. The image processing device according to claim 11, wherein the third determining unit comprises:

a determining subunit configured to determine the target grayscale value according to the initial brightness, the target brightness and the relationship between brightness and grayscale value expressed as $$L=A*(G/255)^{2.2}$$

wherein, L is the target brightness, G is the target grayscale value, and A is the initial brightness.

13. A display device, comprising the image processing device according to claim 10.

14. The display device according to claim 13, wherein the second determining module comprises:

a second determining unit configured to determine an initial brightness and a target brightness of the target area, wherein the target brightness is no larger than the maximum allowable brightness; and a third determining unit configured to determine the target grayscale value according to a relationship between brightness and grayscale value, the initial brightness and the target brightness.

15. The display device according to claim 14, wherein the third determining unit comprises:

a determining subunit configured to determine the target grayscale value according to the initial brightness, the target brightness and the relationship between brightness and grayscale value expressed as $$L=A*(G/255)^{2.2}$$

wherein, L is the target brightness, G is the target grayscale value, and A is the initial brightness.

16. The image processing device according to claim 10, wherein the second determining module comprises:

a second determining unit configured to determine an initial brightness and a target brightness of the target area, wherein the target brightness is no larger than the maximum allowable brightness; and a third determining unit configured to determine the target grayscale value according to a relationship between brightness and grayscale value, the initial brightness and the target brightness.

17. An image processing method, comprising:

receiving an original display screen;

determining a target area in the original display screen, wherein an initial brightness of the target area is larger than a maximum allowable brightness;

determining a target grayscale value of the target area; and adjusting a grayscale value of the target area to the target grayscale value, so that the brightness of the target area does not exceed the maximum allowable brightness, wherein determining the target grayscale value of the target area comprises:

determining an initial brightness and a target brightness of the target area, wherein the target brightness is no larger than the maximum allowable brightness; and determining the target grayscale value according to a relationship between brightness and grayscale value, the initial brightness and the target brightness.

* * * * *